US011173415B1

(12) United States Patent
Yang

(10) Patent No.: US 11,173,415 B1
(45) Date of Patent: Nov. 16, 2021

(54) BUBBLE MACHINE

(71) Applicant: SHENZHEN QIAOHUA INDUSTRIES LIMITED, Shenzhen (CN)

(72) Inventor: Ruishi Yang, Shenzhen (CN)

(73) Assignee: SHENZHEN QIAOHUA INDUSTRIES LIMITED, Shenzhen (CN)

( * ) Notice: Subject to any disclaimer, the term of this patent is extended or adjusted under 35 U.S.C. 154(b) by 0 days.

(21) Appl. No.: 17/115,820

(22) Filed: Dec. 9, 2020

(30) Foreign Application Priority Data

Nov. 9, 2020 (CN) ..... 202022576597.8

(51) Int. Cl.
*A63H 33/28* (2006.01)
*A63J 5/02* (2006.01)

(52) U.S. Cl.
CPC ..... *A63J 5/02* (2013.01); *A63H 33/28* (2013.01)

(58) Field of Classification Search
CPC ..... A63H 33/00; A63H 33/28; A63J 5/025; A63J 5/02
USPC ..... 446/15, 16, 18, 21
See application file for complete search history.

(56) References Cited

U.S. PATENT DOCUMENTS 3,100,947 A * 8/1963 Hellman ..... A63H 33/28 446/16
4,044,496 A * 8/1977 Jernstrom ..... A63H 33/28 446/16
4,062,143 A * 12/1977 Lerman ..... A63H 33/28 446/16
4,767,141 A * 8/1988 Martin ..... A01B 1/02 294/181
2009/0017713 A1* 1/2009 Chung ..... A63H 33/28 446/15

* cited by examiner

*Primary Examiner* — Kien T Nguyen

(57) ABSTRACT

The present disclosure provides a bubble machine, including a film forming nozzle, a film covering body disposed on the film forming nozzle, and fan blades. Airflow generated by rotation of the fan blades flows to the film forming nozzle. The film forming nozzle is driven to swing through a drive mechanism. The drive mechanism includes a dial wheel and a swing rod. A rotating shaft is disposed on a middle of the swing rod. The dial wheel is driven to rotate through a driver. During a rotation process of the dial wheel, a first end of the swing rod swings around the rotating shaft, so that a second end of the swing rod drives the film covering body to swing. The film covering body enables bubble liquid to form a film on the film forming nozzle during a swinging process.

10 Claims, 5 Drawing Sheets

BUBBLE MACHINE

TECHNICAL FIELD

The present disclosure relates to a technical field of bubble machines.

BACKGROUND

Bubble machines are a machine that can be used for generating bubbles, not only can be used as daily entertainment, but also can be used for creating a certain atmosphere for theaters. Each of the bubble machines needs to form a film on a film forming nozzle so that the bubbles can be blown out. A present film forming method drives the film forming nozzle to rotate by an electric machine, the film forming nozzle is immersed into more bubbles to form the film, the film forming method needs to use multiple film forming nozzles so that a certain amount of the bubbles can be blown out.

SUMMARY

Based on above, in order to partly solve one of technical problems in related arts, there is a need to provide a bubble machine in which a film is formed on the film forming nozzle in a swinging manner, and a film covering body has no requirement to rotate by 360 degrees, so that a travel of the film covering body is reduced, and then the film forming nozzle is effectively covered with the film.

The present disclosure provides a bubble machine, including a film forming nozzle, a film covering body disposed on the film forming nozzle, and fan blades. Airflow generated by rotation of the fan blades flows to the film forming nozzle. The film forming nozzle is driven to swing through a drive mechanism. The drive mechanism includes a dial wheel and a swing rod. A rotating shaft is disposed on a middle of the swing rod. The dial wheel is driven to rotate through a driver. During a rotation process of the dial wheel, a first end of the swing rod swings around the rotating shaft, so that a second end of the swing rod drives the film covering body to swing. The film covering body enables bubble liquid to form a film on the film forming nozzle during a swinging process.

Furthermore, the driver is an electric machine driving the fan blades to rotate.

Furthermore, the driver is connected with the dial wheel through a first speed reducer. The first speed reducer includes a turbine disposed on an output shaft of the driver, a first gear connected with the turbine, a shaft rod coaxial with the first gear, and a second gear disposed on the shaft rod. The second gear is connected with the dial wheel. A diameter of the second gear is less than a diameter of the first gear, and the diameter of the second gear is less than a diameter of the dial wheel.

Furthermore, the driver simultaneously drives a penstaltic pump, the peristaltic draws the bubble liquid to provide the film forming nozzle with desired bubble liquid.

Furthermore, the second end of the swing rod includes two blocks, the two blocks are spaced. A driven rod extends from one end of the film covering body and extends into the two blocks. During a swinging process of the swing rod, the two blocks disposed on both sides of the swing rod drive the driven rod to swing back and forth, so that the film covering body swings back and forth at a position of the film forming nozzle.

Furthermore, the swing rod includes a strip-shaped hole disposed on the first end of the swing rod, the strip-shaped hole extends to the second end of the swing rod, and an eccentric poke rod on the dial wheel is disposed inside the strip-shaped hole.

Furthermore, the bubble machine includes a fog generator. The fog generator includes a heating body, fog fluid passes through the heating body to generate fog, and the fog generated by the fog generator flows to the film forming nozzle along with the airflow.

Furthermore, the fog generator includes a fog fluid box, the fog fluid in the fog fluid box is led into a position of the heating body, and the rotating shaft is disposed above the fog fluid box.

Furthermore, an air duct is disposed inside the fog generator, the heating body is disposed inside the air duct, and a fog fluid tube is disposed on the air duct. The fog fluid tube is connected with the peristaltic pump, the driver drives the peristaltic pump, and the fog fluid in the fog fluid box is led into the position of the heating body through the peristaltic pump.

Furthermore, the bubble machine includes an air outlet. The air outlet is disposed below the film forming nozzle, and the airflow generated by rotation of the fan blades flows out from the air outlet and flows upward.

According to above, the present disclosure drives the dial wheel to rotate through the driver, during a rotation process of the dial wheel, the dial wheel drives the swing rod swings back and forth around a middle of the rotating shaft, and further drives the film covering body to swing during the swinging process of the swing rod, thus, after the film covering body brushes a layer of the film on the film forming nozzle clockwise, a liquid film becomes bubbles to blow out under the airflow. At this time, the film covering body directly continues to brush another layer of the film on the film forming nozzle counter-clockwise, so that the film covering body has no requirement to rotate by 360 degrees, and the travel of the film covering body is reduced. The film covering body makes a film forming speed of the film forming nozzle faster, thus increasing an amount of blown bubbles.

Figure 1:
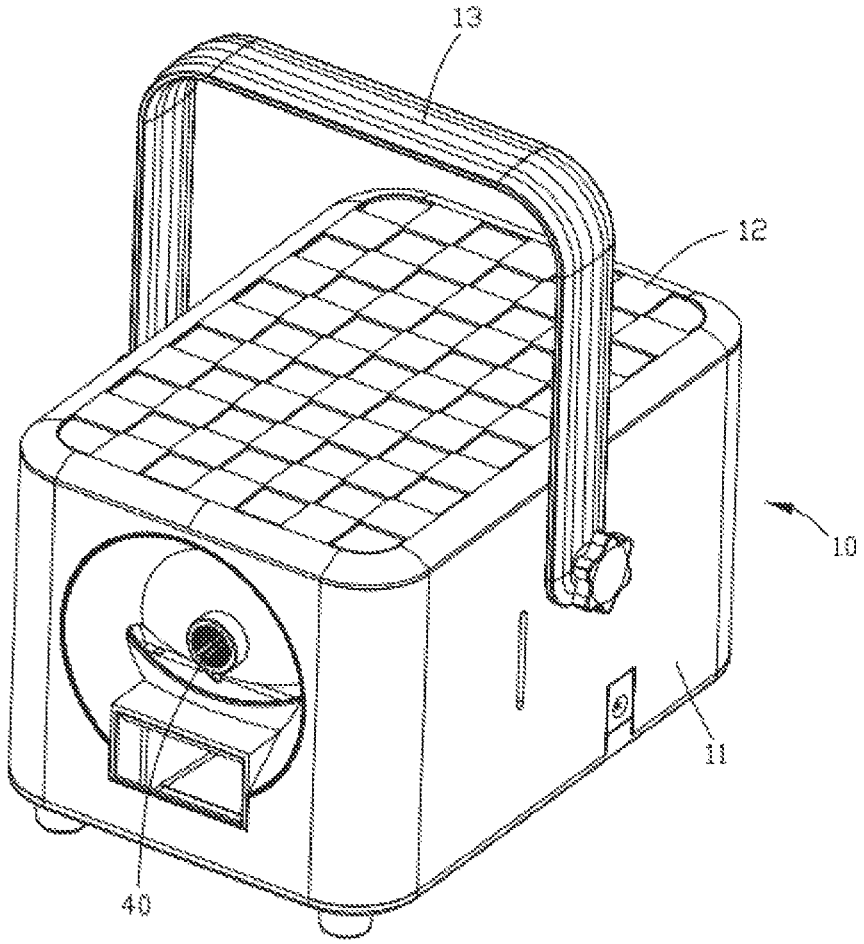
FIG. 1 is a three-dimensional structural schematic diagram of a bubble machine according to one embodiment of the present disclosure.

The present disclosure is further illustrated by following detailed description in conjunction with the accompanying drawings.

DETAILED DESCRIPTION

Technical solutions in embodiments of the present disclosure are clearly and completely described in connection with the accompanying drawings in the embodiments of the present disclosure, and obviously, the described embodiments are merely a part of the embodiments of the present disclosure and not all embodiments. All other embodiments are obtained by those skilled in the art based on the embodiments of the present disclosure without creative efforts, all of which fall within scopes of the present disclosure. It is to be understood that the drawings are for purposes of illustration and description only and are not intended to limit the present disclosure. Connection relationships shown in the drawings are for convenience only and do not limit methods of connection.

Figure 2:
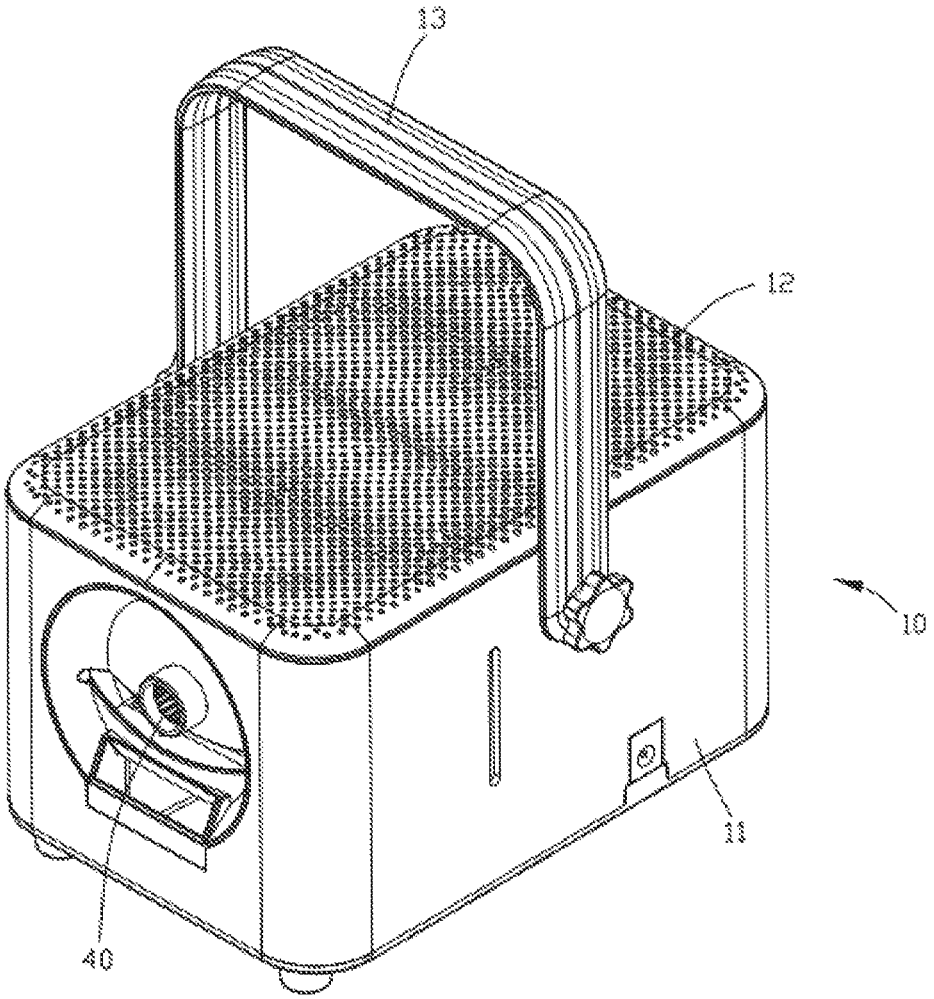
FIG. 2 is a three-dimensional structural schematic diagram of the bubble machine showing another appearance according to one embodiment of the present disclosure.

As shown in FIG. 1, the present disclosure provides a bubble machine, including a housing 10. The housing includes a bottom housing 11 and a face cover 12 disposed on the bottom case 11, the face cover being openable. A carrying handle 13 is disposed on the housing 10, which is convenient for users to carry the bubble machine. It should be noted that an appearance of the bubble machine may be designed accordingly as desired and may also be designed as an appearance structure as shown in FIG. 2.

Figure 3:
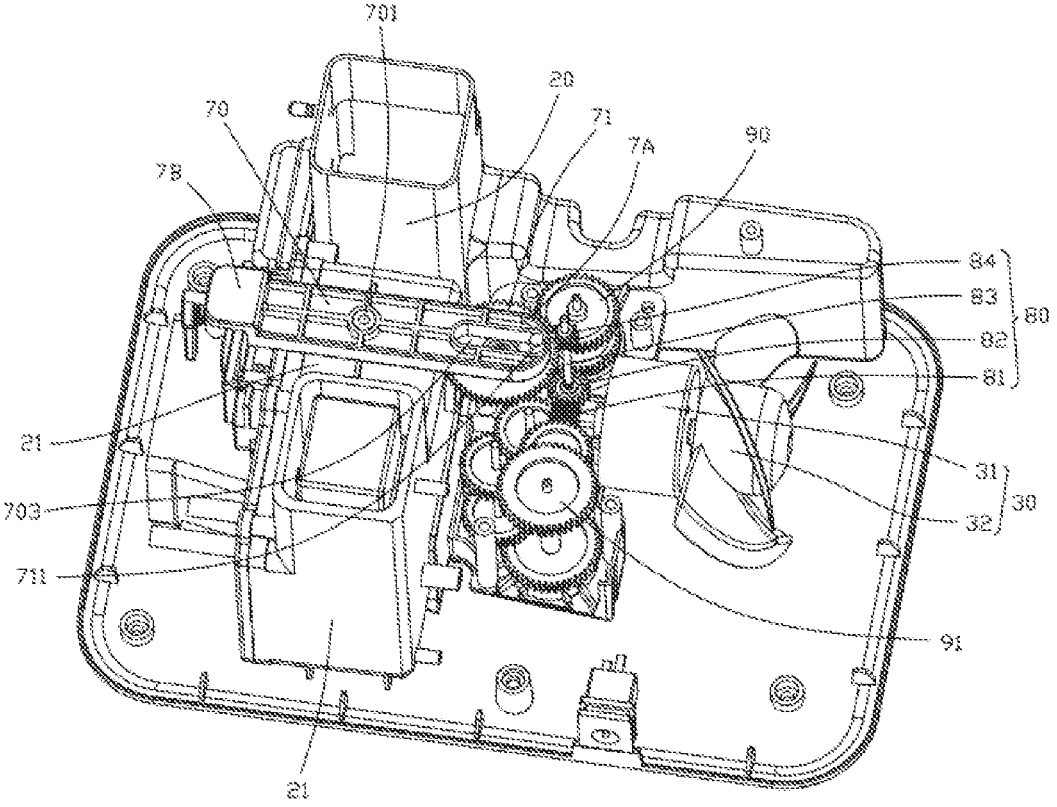
FIG. 3 is a schematic diagram of an internal structure of the bubble machine.

As shown in FIG. 3, a bubble liquid box 20 and a fog fluid box 21 are disposed inside the housing 10. The bubble liquid box 20 is configured to store bubble liquid for blowing bubbles, and the fog fluid box 21 is configured to store fog fluid for generating fog. The bubble liquid box 20 is disposed on a side edge of the fog fluid box 21. Box covers are disposed on both tops of the bubble liquid box 20 and the fog fluid box 21. When the box covers are opened, the bubble liquid is added into the bubble liquid box 20, and the fog fluid is added into the fog fluid box 21. In one embodiment, when the face cover 12 is opened, the box covers are exposed, so that the box covers are convenient to be opened.

Figure 4:
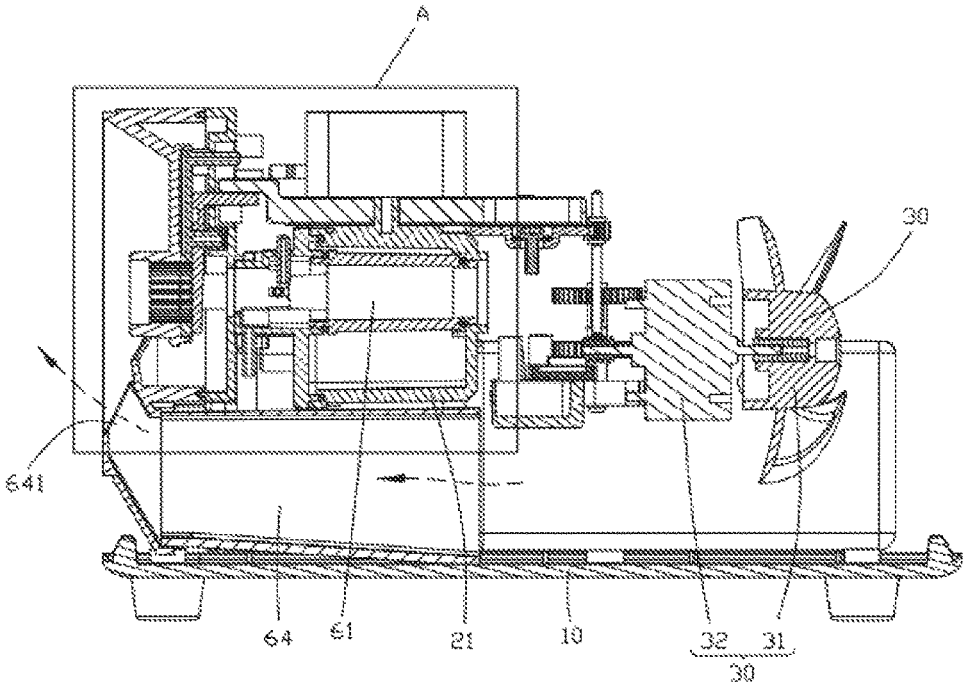
FIG. 4 is a cross sectional view of the bubble machine.
Figure 5:
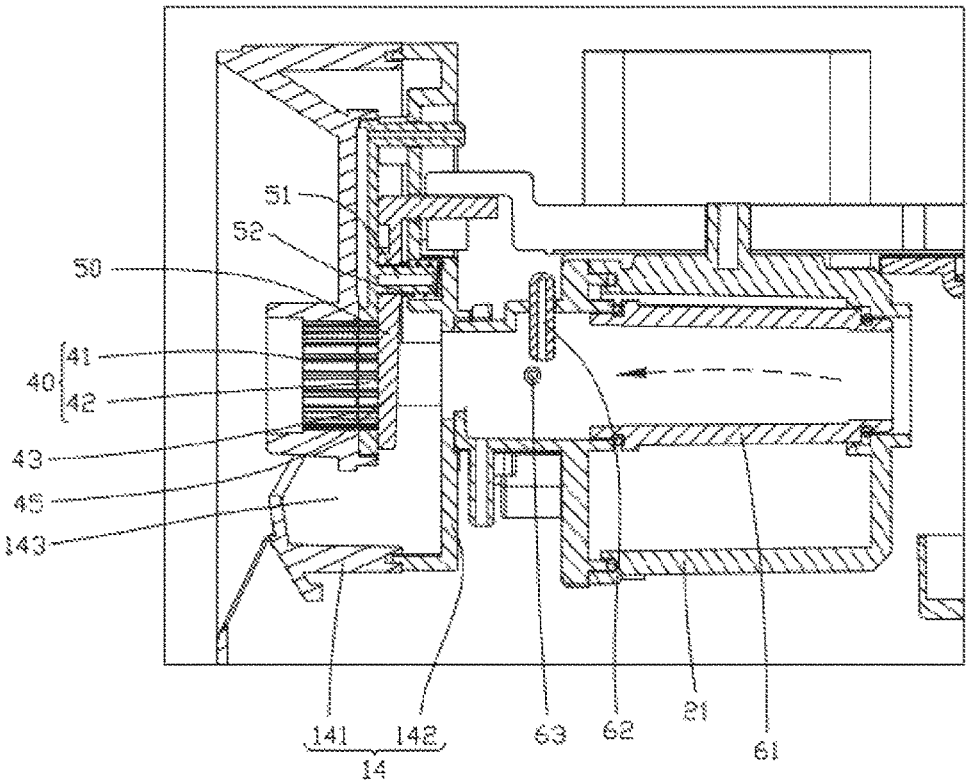
FIG. 5 is an enlarged view of portion A shown in FIG. 4.

A fan 30 are disposed inside the housing 10. The fan 30 is disposed on a rear inner side of the housing 10. As shown in FIGS. 4 and 5, a film forming nozzle 40 is disposed on a front end of the housing 10, the film forming nozzle 40 is configured to form a film. Airflow generated during operation of the fan 30 flows to the film forming nozzle 40, so that the film formed on the film forming nozzle 40 is blown into bubbles.

In one embodiment, a film covering body 50 is disposed on the film forming nozzle 40, the film covering body 50 is rotatably disposed on a corresponding position of the film forming nozzle 40. The film forming nozzle may be disposed on a nozzle 14 at the front end of the housing 10. The nozzle 14 includes a front nozzle housing 141 which is rearwardly concave and a rear nozzle housing 142 disposed on a rear side of the front nozzle housing 141. A first film forming nozzle body 41 is disposed in a notch of the front nozzle housing 141, a second film forming nozzle body 42 is disposed in a cavity of the nozzle 14. The first film forming nozzle body 41 and the second film forming nozzle body 42 are spaced to form the film forming nozzle 40. The bubble liquid stored in the bubble liquid box 20 flows into a gap 43 between the first film forming nozzle body 41 and the second film forming nozzle body 42, thereby better wetting the film forming nozzle 40.

The film covering body 50 is rotatably disposed on a rear side of the second film forming nozzle body 42 and is tightly attached to the second film forming nozzle body 42, so that the film covering body is hidden. In a rotation process of the film covering body 50, the film covering body 50 brushes a layer of the film on the second film forming nozzle body 42. The film covering body 50 is rotatably connected by a rotating shaft, the film covering body 50 is further connected with an elastomer 52. The film covering body 50 is elastically pressed on a rear side surface of the second film forming nozzle body 42 through elastic force of the elastomer 52.

The cavity 143 of the nozzle 14 may constitute a collection tank for collecting bubbles dripping from the film forming nozzle 40, and then bubbles in the collection tank return to the bubble liquid box 20 for recycle and reuse.

An air duct 61 is disposed on a rear side of the film forming nozzle 40. The air duct 61 directly face the film forming nozzle 40 and is in a straight cylinder shape. Airflow formed by the fan 30 is blown from the air duct 61 to the film forming nozzle 40. In one embodiment, the air duct is disposed in the fog fluid box 21, so that a space is reasonably used to reduce a volume of the bubble machine.

A heating body 63 is disposed inside the air duct 61. The heating body forms a fog generator, the fog fluid in the fog fluid box 21 passes through the heating body 63 to generate fog, and the fog flows to the film forming nozzle 40 along with the airflow.

An airflow passage 64 is disposed below the air duct 61, an air outlet 641 is disposed on a front end of the airflow passage 64. The air outlet 641 is disposed below the film forming nozzle 40. The air outlet 641 is faced upward. The airflow generated by the fan 30 can not only enter the air duct 61, but also a portion of the airflow can enter the airflow passage 64, and the airflow flows out of the air outlet 641. Due to a fact that the air outlet 641 is faced upward, so that the airflow flows upward, thereby causing blown bubbles to float upward.

Figure 6:
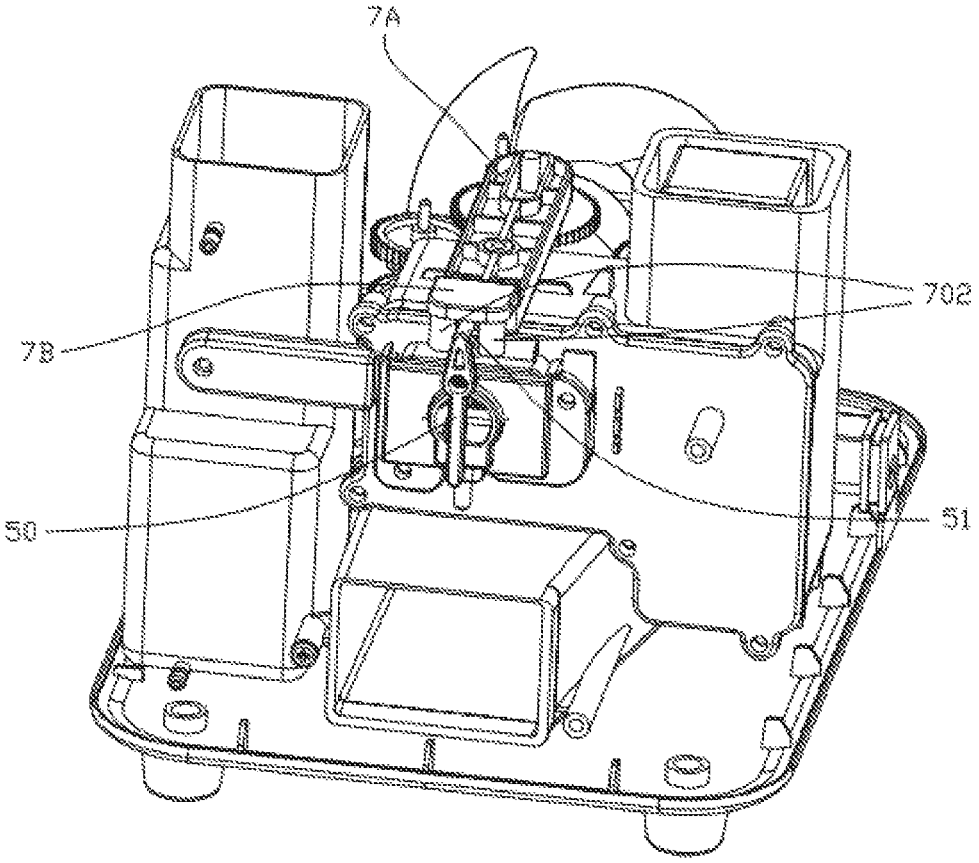
FIG. 6 is a schematic diagram of a swing rod driving a film covering body to swing.

As shown in FIGS. 3 and 6, the bubble machine further comprises a swing rod 70 and a dial wheel 71. A rotating shaft 701 is disposed on a middle of the swing rod 70. The dial wheel 71 is driven to rotate through a driver 32. In a rotation process of the dial wheel 71, the dial wheel 71 drives a first end 7A (shown as a rear end in the figures) of the swing rod 70 swing around the rotating shaft 701, thereby driving the film covering body 50 to swing through a second end 7B (shown as a front end in the figures) of the swing rod 70. The film covering body 50 brushes a layer of the film on the film forming nozzle 40 clockwise, then the liquid film becomes bubbles to blow out under the airflow. At this time, the film covering body 50 directly continues to brush another layer of the film on the film forming nozzle 40 counter-clockwise, compared with that the film covering body 50 directly rotates by 360 degrees through an electric machine, the swinging film covering body 50 has no requirement to rotate by 360 degrees, and the travel of the film covering body 50 is reduced. The film covering body 50 makes a film forming speed of the film forming nozzle 40 faster, thus increasing an amount of blown bubbles.

In one embodiment, the driver 32 is the electric machine 32 of the fan 30, that is, the driver 32 swings the swing rod 70 while rotating fan blades 32 of the fan 30, thereby saving a number of the driver 32.

The swing rod 70 is disposed above the fog fluid box 21, the rotating shaft 701 connected to the middle of the swing rod 70 is further disposed on the fog fluid box 21, and the swing rod 70 swings above the fog fluid box 21.

Due to a fact that the driver 32 is the electric machine 32 of the fan 30, a faster rotation speed of the electric machine 32 rotates the fan blades 31 to generate airflow having a certain flow rate. In order to control swing frequency of the swing rod 70, the driver 32 is connected with s first speed reducer 80, and the first speed reducer 80 is connected with the dial wheel 71.

Specifically, the first speed reducer 80 includes a turbine 81 disposed on an output shaft of the driver 32, a first gear 82 connected with the turbine 81, a shaft rod 83 coaxial with the first gear 82, and a second gear 84 disposed on the shaft rod 83. The second gear 84 is connected with the dial wheel 71. A diameter of the second gear 84 is less than a diameter of the first gear 82, and the diameter of the second gear 84 is less than a diameter of the dial wheel 71. Thus, a secondary deceleration is achieved. The fan blades 31 is connected to a rear side of the driver 32, and the output shaft of the driver 32 is on a front side of the driver 32.

The second gear 84 is spaced a distance from the first gear 82. The shaft rod 83 is a vertical rod, the second gear 84 is disposed on an upper end of the shaft rod to be connected with the dial wheel 71 located on the fog fluid box 21. When the driver 32 rotates at a high speed, the driver may be decelerated by the first speed reducer 80, thereby slowing down a rotation speed of the dial wheel 71, which controls the swing frequency of the swing rod 70 within a reasonable range.

As shown in FIG. 6, the second end 7B of the swing rod 70 includes two blocks 702, the two blocks 702 are spaced. A slot is form between the two blocks 702. A driven rod 51 extends from one end of the film covering body 50 and extends into the slot. During the swinging process of the swing rod 70, the two blocks 702 disposed on both sides of the swing rod 70 drive the driven rod 20 to swing back and forth, so that the film covering body 50 swings back and forth at a position of the film forming nozzle 40. When the film covering body 50 swings back and forth, the film covering body 50 is elastically attached to the film forming nozzle 40 depending on the elastomer 52. The driven rod 51 can be perpendicular to the swing rod 70, the blocks 702 can be perpendicular to the swing rod 70, and the swing rod 70 is perpendicular to the film covering body 50. Thus, the swing rod 70 extending in a forward and backward direction to be close to the driver 32 at rear is achieved.

As shown in FIG. 3, the swing rod 70 includes a strip-shaped hole 703 disposed on the first end 7A of the swing rod 70, the strip-shaped hole 703 extends to the second end 7B of the swing rod 70, and an eccentric poke rod 711 on the dial wheel 71 is disposed inside the strip-shaped hole 703. During rotation process of the dial wheel 71, the eccentric poke rod 711 moves inside the strip-shaped hole 703 so as to enable the swing rod 70 to swing back and forth.

The bubble machine inputs the bubble liquid in the bubble liquid box 20 into the gap 43 of the first film forming nozzle body 41 and the second film forming nozzle body 42 through a peristaltic pump 90. The bubble machine inputs the fog fluid in the fog fluid box 21 into the heating body 63 through a peristaltic pump 91. Specifically, a fog fluid tube 62 (shown in FIG. 5) is disposed on the air duct 61, the fog fluid tube 62 is connected with the peristaltic pump 91. The driver 32 further provides power to drive the peristaltic pump 90 and the peristaltic pump 91 to work. Therefore, only one driver 32 needs to be disposed inside the bubble machine to rotate the fan blade 31, swing the swing rod 70, and supply the bubble liquid and the fog fluid to the peristaltic pump 90 and the peristaltic pump 91.

It should be noted that one speed reducer can be disposed between the peristaltic pump 90 and the turbine 81, and another speed reducer can be disposed between the peristaltic pump 91 and the turbine 81, so that the peristaltic pump 90 and the peristaltic pump 91 can be operated at a reasonable speed.

The above-disclosed are only preferred embodiments of the present disclosure, which certainly cannot be used to limit the scopes of the present disclosure. Therefore, equivalent changes made according to the claims of the present disclosure still fall within the scopes of the present disclosure.

What is claimed is:

1. A bubble machine, comprising;

a film forming nozzle;

a film covering body disposed on the film forming nozzle; and fan blades;

wherein airflow generated by rotation of the fan blades flows to the film forming nozzle; the film forming nozzle is driven to swing through a drive mechanism; the drive mechanism comprises a dial wheel and a swing rod; a rotating shaft is disposed on a middle of the swing rod; the dial wheel is driven to rotate through a driver; during a rotation process of the dial wheel, a first end of the swing rod swings around the rotating shaft, so that a second end of the swing rod drives the film covering body to swing; and the film covering body enables bubble liquid to form a film on the film forming nozzle during a swinging process.

2. The bubble machine according to claim 1, wherein the driver is an electric machine driving the fan blades to rotate.

3. The bubble machine according to claim 2, wherein the driver is connected with the dial wheel through a first speed reducer; the first speed reducer comprises a turbine disposed on an output shaft of the driver, a first gear connected with the turbine, a shaft rod coaxial with the first gear, and a second gear disposed on the shaft rod; the second gear is connected with the dial wheel; a diameter of the second gear is less than a diameter of the first gear, and the diameter of the second gear is less than a diameter of the dial wheel.

4. The bubble machine according to claim 3, wherein the driver simultaneously drives a peristaltic pump, the peristaltic pump draws the bubble liquid to provide the film forming nozzle with desired bubble liquid.

5. The bubble machine according to claim 1, wherein the second end of the swing rod comprises two blocks, the two blocks are spaced; a driven rod extends from one end of the film covering body and extends into the two blocks; during a swinging process of the swing rod, the two blocks disposed on both sides of the swing rod drive the driven rod to swing back and forth, so that the film covering body swings back and forth at a position of the film forming nozzle.

6. The bubble machine according to claim 1, the swing rod comprises a strip-shaped hole disposed on the first end of the swing rod, the strip-shaped hole extends to the second end of the swing rod, and an eccentric poke rod on the dial wheel is disposed inside the strip-shaped hole.

7. The bubble machine according to claim 1, further comprising a fog generator; wherein the fog generator comprises a heating body, fog fluid passes through the heating body to generate fog, and the fog generated by the fog generator flows to the film forming nozzle along with the airflow.

8. The bubble machine according to claim 7, the fog generator further comprises a fog fluid box, the fog fluid in the fog fluid box is led into a position of the heating body, and the rotating shaft is disposed above the fog fluid box.

9. The bubble machine according to claim 8, an air duct is disposed inside the fog generator, the heating body is disposed inside the air duct, and a fog fluid tube is disposed on the air duct; the fog fluid tube is connected with a peristaltic pump, the driver drives the peristaltic pump, and the fog fluid in the fog fluid box is led into the position of the heating body through the peristaltic pump.

10. The bubble machine according to claim 1, further comprising an air outlet, wherein the air outlet is disposed below the film forming nozzle, and the airflow generated by rotation of the fan blades flows out from the air outlet and flows upward.

* * * * *